United States Patent [19]

Larson

[11] 4,034,964

[45] July 12, 1977

[54] FLUIDIC MIXER

[75] Inventor: Charles L. Larson, Grants Pass, Oreg.

[73] Assignee: Jeddeloh Bros. Sweed Mills, Inc., Gold Hill, Oreg.

[21] Appl. No.: 630,910

[22] Filed: Nov. 12, 1975

[51] Int. Cl.[2] ..... B01F 5/00

[52] U.S. Cl. ..... 259/4 R

[58] Field of Search ..... 259/4 R, 7–10; 48/180 R, 180 M, 180 B; 138/37, 40, 42

[56] References Cited

U.S. PATENT DOCUMENTS

| | | | |
|---|---|---|---|
| 1,385,860 | 7/1921 | Chenot | 259/9 |
| 1,626,487 | 4/1927 | Warren | 259/4 R |
| 1,809,375 | 6/1931 | Chase | 48/180 R |
| 2,409,339 | 10/1946 | Ballard | 259/9 |
| 3,008,808 | 11/1961 | Hodges | 259/7 X |
| 3,844,541 | 10/1974 | Artho et al. | 259/4 R |

*Primary Examiner*—Philip R. Coe

*Attorney, Agent, or Firm*—Kolisch, Hartwell, Dickinson & Stuart

[57] ABSTRACT

A fluidic mixer for commingling fluidic materials including a conduit having a first end and a second end which loosely receives an elongate spiral rod. The spiral rod is formed with a core extending axially and substantially the length of the rod to define a closed center. Multiple helical flights are integrally joined to the core and have peripheral diameters dimensioned less than the inside diameter of the conduit. Notches are provided in alternate peripheral edges of the helical flights so that fluidic materials introduced in the conduit may travel in a spiral path defined by the helical flights, a path between the peripheral diameter and the inside conduit diameter and a path across the notches to thereby effect continuous and complete commingling of the fluidic materials.

9 Claims, 3 Drawing Figures

FLUIDIC MIXER

BACKGROUND OF THE INVENTION

1. Field of the Invention

The present invention relates to fluidic mixing devices and more particularly to an elongate mixing device used in conjunction with a fluid dispensing gun.

In many manufacturing processes it is necessary to completely mix and blend particulate solids, liquids or gases. However, a problem is presented when it is desired to mix materials having different viscosities, especially those materials having high viscosities which diffuse slowly. For instance, in the wood products industry and more particularly in plywood manufacturing, it is necessary to fill knotholes or other imperfections in plywood panels with a mix of resin and catalyst. It is imperative that the resin and catalyst be completely mixed before being used as a knothole or wood defect filler.

Furthermore, it is necessary in the plywood manufacturing industry to use a mixing device which may be readily disassembled and cleaned due to the fact that resin and catalyst set up or harden very quickly. If a mixing device is not flushed with a solvent after discharge of the resin and catalyst, residue may harden and prevent further discharge through the device. Thus, it becomes necessary that the fluidic mixer must be constructed of components easily disassembled.

2. Description of the Prior Art

A static mixing device is disclosed in U.S. Pat. No. 3,865,352. A mixing tube for mixing a plurality of fluids during their passage through the tube contains a hollow tube packed with shaped pieces, each of the pieces having a disk having at least one projection perpendicularly attached thereto. It is necessary that a plurality of shaped pieces be packed into the tube and it is readily apparent that some difficulty would be experienced in removing the shaped pieces if they became lodged within the tube due to hardening of mixed mterials. Also, it is apparent that a shaped piece could possibly work its way to an outlet nozzle of the tube to inadvertently plug up the nozzle. It is to be appreciated that applicant's invention utilizes a one-piece spiral rod which may be readily removed from a tube and which further will not impede flow through a discharge nozzle.

While not describing a mixing device per se, U.S. Pat. No. 2,020,194 discloses an arrangement for producing a helical flow of flue gases within a tube by providing an extended helical guide member within a pipe. The height of the helical guide member may be smaller than the radius of the pipe cross-sectional area and permits a flue gas traveling down the pipe to move somewhat in a whirl. However, it is to be noted that such a helical device would not adequately mix fluidic components because the helix is wound in a manner to provide an open region extending the length of the tube substantially in the middle of the helix. Thus, it becomes apparent that if fluidic components were introduced into one end of the tube, portions of the components could travel down the open region extending along the length of the tube and not be subjected to mixing agitation.

A static type foam mixing head to provide a polyurethane foam is set forth in U.S. Pat. No. 3,361,412. Here, a body member having a central chamber is provided in which a series of baffle structures permit expansion of foam before the foam issues from the outlet of the tube. It is to be noted that the baffle structures are generally circular in cross section and do not premit for passage of fluidic components along their outer peripheries between the inside diameter of the tube.

Further examples of mixing devices are described in U.S. Pat. No. 3,286,992 and 3,664,638. Both of these mixing devices employ a tube in which are disposed a plurality of serially arranged curved elements, each constructed of a thin flat sheet having a width approximately equaling the inner diameter of the tube and each having a length preferably 1.25 to several times its width. Each of the curved elements is twisted so that its upstream and downstream edges are substantially flat and arc at a substantial angle to each other.

SUMMARY OF THE INVENTION

The present invention provides a fluidic mixer for commingling and converting an input stream of multiple fluidic components into a homogeneous output stream. The fluidic mixer of the present invention utilizes an elongate conduit having a fluid introduction first end and a second discharge end. Disposed within the elongate conduit is an elongate spiral rod loosely received therewithin which includes a core extending axially and substantially the length of the spiral rod to define a closed core. Multiple helical flights are integrally joined to and radially extend from the core and have a peripheral diameter dimensioned less than the inside diameter of the conduit. Furthermore, a selected plurality of the helical flights are provided with notches or grooves on peripheral edges of the flights. Thus, it is apparent that the present invention provides for multiple directional travel of fluidic components to be mixed after the components are introduced through the first end of the conduit. Specifically, the fluidic components may travel in a generally spiral path from one helical flight to an adjacent downstream flight. In addition, another portion of the components will travel in the region between the outer peripheries of the helical flights and the inside diameter of the tube in order to join up and further mix and blend with those fluidic component portions being moved downstream in a spiral path. The aforementioned notches further enable a third portion of the fluidic components to be diverted from either an outer helical flight periphery passage or spiral passage to a more direct downstream movement across a helical flight to thereby mix and blend with fluidic components adjacent a subsequent downstream helical flight.

It is a general object of the present invention to provide a mixing rod which may be disposed within an elongate tube connected to a fluidic component dispensing apparatus such as a mixing gun. It is necessary to have a somewhat elongate conduit and mixing rod disposed therewithin to permit an individual filling knotholes in plywood sheets to stand upright and place a discharge nozzle of the conduit adjacent to the knothole or imperfection for dispensing a filling mixture, such as a thoroughly mixed resin and catalyst, into the hole.

Another object of the present invention is to provide a fluidic mixer which may be conveniently constructed having only a single continuous mixing rod disposed within a conduit to overcome deficiencies inherent in mixers utilizing a plurality of components assembled within a tube.

A further object of the present invention is to provide a spiral rod within a conduit which utilizes a closed center to prevent undisturbed central passage of fluidic components which would not otherwise be mixed.

Still another object of the present invention is to provide a fluidic mixer which may be easily cleaned. Specifically, the present invention contemplates the use of a one-piece elongate spiral rod which is disposed within a tube and which may be easily and manually removed for cleaning or replacement.

Still another object of the present invention is to provide a fluidic mixer which may generally operate as a static mixer, i.e., no external mechanical agitation is employed to drive the spiral rod disposed within the conduit.

Yet another object of the present invention is to provide a fluidic mixer which will divert and direct fluidic components introduced into the aforementioned conduit to be diverted and mixingly directed in a plurality of directions in order to differ the rates of fluid flow and thereby ensure complete and continuous mixing and blending.

Still another object of the present invention is to provide a fluidic mixer which may be readily adapted to a fluid dispensing gun for use in industrial and manufacturing processes.

Additional objects of the present invention reside in the specific construction of the exemplary apparatus hereinafter particularly described in the specification and shown in the drawings.

BRIEF DESCRIPTION OF THE DRAWINGS

Novel features of the fluidic mixing device in accordance with the present invention will be more readily understood from a consideration of the following description taken together with the accompanying drawings, in which a preferred adaption is illustrated with the various parts thereof identified by suitable reference characters in each of the views, and in which.

DETAILED DESCRIPTION OF THE INVENTION

Figure 1:
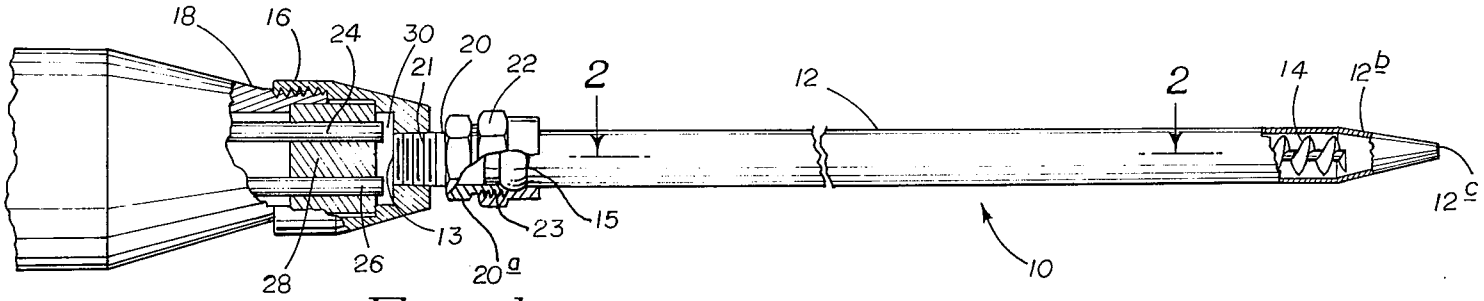
FIG. 1 is a partially cut away view of a nozzle from a mixing gun which dispenses fluidic components to be comingled into an elongate tube having a loosely disposed spiral mixing rod disposed therein in accordance with the present invention.
Figure 2:
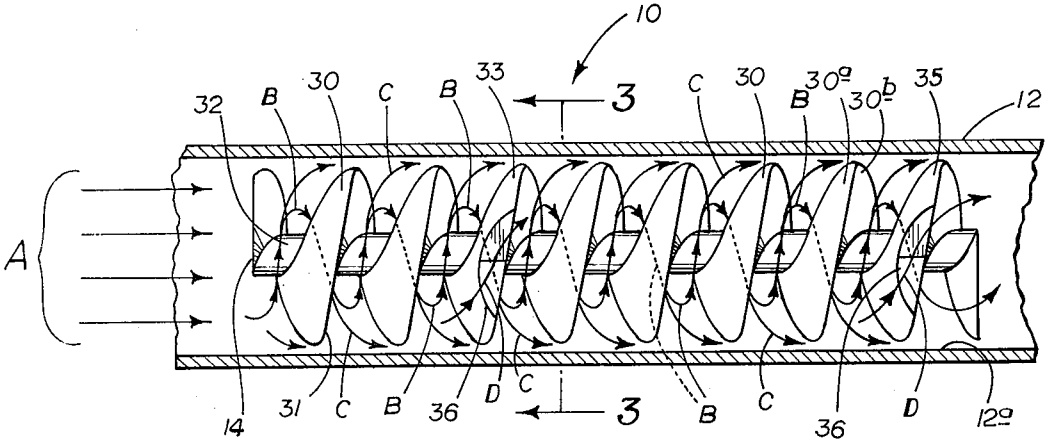
FIG. 2 is a cut-away view taken along lines 2—2 of FIG. 1 and in more detail illustrates the configuration of the spiral rod in accordance with the present invention.

With reference directed particularly to FIGS. 1 and 2, a preferred embodiment of the fluidic mixer in accordance with the principles of the present invention is generally designated at 10.

Fluidic mixer 10 comprises a tube or conduit 12 having disposed therewithin an elongate spiral rod 14. The tube 12 is connected to a nozzle cap nut 16 by means of a fitting 20. The nozzle cap nut 16 is threadedly connected to a manifold 18. The manifold 18 is secured to or forms part of a fluid dispensing unit or gun (not shown). The fitting 20 is one piece and includes hollow threaded portions 21 and 23 separated by a nut 20*a*. Threaded portion 21 is threadedly connected to the cap nut 16. The conduit 12 includes a lip or rim 15 formed thereon which limits the extent to which the tube 12 may be inserted into the threaded portion 23. A fastening nut 22 threadedly secured to portion 23 detachably mounts the tube 12 to the fitting 20. Fluid dispensing tubes 24 and 26 are shown secured within cap nut 16 by means of an orienting block or support 28. Dispensing tubes 24 and 26 direct fluidic components into an initial mixing chamber 30 which communicates with introduction end 13 of the fitting 20. While only two dispensing tubes 24, 26 are illustrated, it is to be appreciated that a plurality of dispensing tubes could be used to introduce fluidic components to be mixed within tube 12.

With reference now directed more particularly to FIG. 2 of the drawings, specific features of spiral rod 14 will be described. Spiral rod 14 is slidably received within tube 12 and is free from connection therewithin. Rod 14 incorporates a plurality of helical flights 30 integrally joined to and radially extending from a core 32. Core 32 extends substantially the length of spiral rod 14 and forms a closed center. In a preferred embodiment, each of the helical flights 30 is formed with a concave surface 30*a* and a convex surface 30*b*. However, it is to be noted that the surfaces may take forms of other configurations.

Helical flights 30 have a periphery 31 defining a diameter dimensioned less than the inside diameter of tube 12. Thus, it is apparent that when fluidic materials are introduced into the inlet of tube 12, a fluid-flow region 34 will be disposed between periphery 31 and the inside surface 12*a* of tube 12. The function of interior region 34 will be subsequently described.

A principal feature of the present invention is the provision of a plurality of fluid diverting notches 36 formed on selected helical flights 30. Each notch is conveniently arranged with intersecting cut faces 36*a* and 36*b*. FIG. 2 of the drawings indicates a notch on helical flights 33 and 35, but it is to be noted that notches 36 may be disposed as frequently as required to effectuate consistent mixing and blending.

Figure 3:
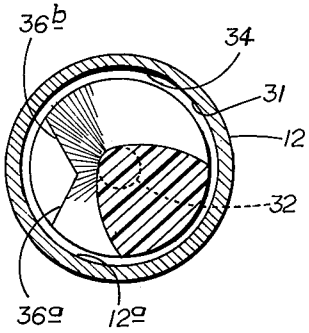
FIG. 3 is a cross-sectional view of the tube and spiral rod taken along lines 3—3 of FIG. 2.

From a consideration of FIG. 3, it can be seen that the area provided for fluid flow through each notch 36 is a substantial amount of the fluid flow area between the outer periphery of a flight and the inside diameter of tube 12.

The mixing and blending of fluidic materials introduced into tube 12 will now be particularly described as the materials are mixed by means of spiral rod 14. Fluidic materials generally enter through an end of tube 12 in the direction of arrows A as schematically shown in FIG. 2. Components of the fluidic materials are then diverted in a spiral path around core 32 and over faces 30*a* and 30*b* in the direction of spiral arrows B. However, due to the existence of space 34 caused by fluid pressure, a portion of the fluidic materials is directed through space 34 in the direction of arrows C. While FIG. 2 is a side view, it must be remembered that arrows C cover a path passing completely over each periphery 31 adjacent the next succeeding helical flight 30. Further, it is to be noted that portions of the fluidic components will be diverted through notch faces 36*a*, 36*b* in the direction of arrows D so as to flow more quickly than the fluidic components being spiraled and channeled in region 34. Thus, it may be appreciated that the fluidic components to be mixed travel downstream in a generally spiral path, a path over the outer peripheries of the helical flights and in paths through the fluid diverting notches 36. The resultant mixing ensures that a homogeneous output will be directed through tapered portion 12*b* of nozzle 12 for discharge through outlet 12*c*.

While the present invention may be generally characterized as a static mixer, it is to be noted that spiral rod 14 may be slightly rotated due to the action of fluidic components impinging upon surfaces 30*a* and 30*b*. Such a rotation, however slight, may further add to the mixing capabilities of the present invention. It can be appreciated that while no external mechanical agitation is applied to spiral rod 14, it nonetheless may provide some movement in order to aid mixing.

Because it is contemplated that resin and catalyst or other materials which readily harden may be mixed using the mixer of the present invention, it is important to note that the mixer 10 may be readily disassembled for cleaning. Rapid disassembly is important because resin and catalyst residue will quickly harden within the tube 12 unless it and the spiral rod 14 are immediately cleaned after use.

Thus, upon loosening of the fastening nut 22, the tube 12 may be quickly detached from the fitting 20. Because the spiral rod 14 is not connected within the tube 12, such rod may be slidably removed from the tube 12. The tube 12 and the spiral rod 14 may then be cleaned and reassembled. Additionally, if a rod becomes damaged or worn, it may be quickly replaced.

While the invention has been particularly shown and described with reference to the foregoing preferred embodiment thereof, it will be understood by those skilled in the art that others changes in form and detail may be made therein without departing from the spirit and scope of the invention as defined in the appended claims.

What is claimed is:

1. A mixer for commingling fluidic materials comprising:

elongate conduit means having a fluid introduction first end and a fluid discharge second end; and elongate rod means received free of connection within said conduit means, said rod means including a core extending axially and substantially the length of said rod means to define a closed center wherein multiple helical flights are integrally joined to and radially extend from said core, said flights having peripheral diameters dimensioned less than the inside diameter of said conduit means such that a fluid flow region is provided between the outer periphery of said flights and said inside diameter for permitting a first portion of introduced fluidic materials to impinge against said helical flights and said core in a continuing spiral path and to permit a second portion of said introduced fluidic materials to travel in paths between said peripheral diameter and said inside diameter to thereby effect continuous commingling of the fluidic materials for eventual discharge.

2. A fluidic mixer as described in claim 1, wherein a plurality of said helical flights are provided with fluid diverting notches for enabling components of said introduced fluidic materials to follow a shortened path from a notched helical flight to an adjacent helical flight to accelerate fluidic commingling.

3. A fluidic mixer as described in claim 2, wherein said fluid diverting notches are defined by segments cut away from a peripheral region of said plurality of notched helical flights.

4. A fluidic mixer as described in claim 3, wherein each of said helical flights is bounded on one side by a concave surface and on the other side by a convex surface.

5. A fluidic mixer as described in claim 1, wherein said conduit means has a tapered, generally conically shaped segment of decreasing diameter preceding said second end, an internal portion of said segment providing a seat for said spiral rod means.

6. A mixer for commingling fluidic materials comprising:

elongate conduit means having a fluid introduction first end and a fluid discharge second end, said first end adapted to be detachably connected to a fluid dispenser; and elongate rod means received free of connection within said conduit means, said rod means including a core extending axially and substantially the length of said rod means to define a closed center wherein multiple helical flights are integrally joined to and radially extend from said core, said flights having peripheral diameters dimensioned less than the inside diameter of said conduit means such that a fluid flow region is provided between the outer periphery of said flights and said inside diameter for permitting a first portion of introduced fluidic materials to impinge against said helical flights and said core in a continuing spiral path and to permit a second portion of said introduced fluidic materials to travel in paths between said peripheral diameter and said inside diameter to thereby effect continuous commingling of the fluidic materials for eventual discharge;

said rod means being slidably removable from said conduit means upon detachment of said conduit means from said dispenser.

7. A fluidic mixer as described in claim 6, wherein a plurality of said helical flights are provided with fluid diverting notches for enabling components of said introduced fluidic materials to follow a shortened path from a notched helical flight to an adjacent helical flight to accelerate fluidic commingling.

8. A fluidic mixer as described in claim 7, wherein said fluid diverting notches are defined by segments cut away from a peripheral region of said plurality of notched helical flights.

9. A mixer for commingling fluidic materials comprising:

elongate conduit means having a fluid introduction first end and a fluid discharge second end; and elongate rod means received within said conduit means, said rod means including a core extending axially and substantially the length of said rod means to define a closed center wherein multiple helical flights are integrally joined to and radially extend from said core, said flights having peripheral diameters dimensioned less than the inside diameter of said conduit means such that a fluid flow region is provided between the outer periphery of said flights and said inside diameter for permitting a first portion of introduced fluidic materials to impinge against said helical flights and said core in a continuing spiral path and to permit a second portion of said introduced fluidic materials to travel in paths between said peripheral diameter and said inside diameter;

wherein a plurality of said helical flights are provided with fluid diverting notches, said notches being defined by segments cut away from the peripheral portion of the flight, said notches enabling components of the introduced fluidic materials to follow shortened paths from a notched helical flight to an adjacent helical flight, each of said notches defining an area which is a substantial portion of the nonspiral flow area between the peripheral diameter of a notched flight and the inside diameter of said conduit means.

* * * * *